US006508466B1

(12) United States Patent
Rendleman

(10) Patent No.: US 6,508,466 B1
(45) Date of Patent: Jan. 21, 2003

(54) EASY HANDLING GAMING CHIP

(75) Inventor: Thomas G. Rendleman, Olathe, KS (US)

(73) Assignee: Trend Plastics, Inc., Olathe, KS (US)

( * ) Notice: Subject to any disclaimer, the term of this patent is extended or adjusted under 35 U.S.C. 154(b) by 0 days.

(21) Appl. No.: 09/430,002

(22) Filed: Oct. 29, 1999

(51) Int. Cl.[7] ..... A63B 71/00

(52) U.S. Cl. ..... 273/148 R; 264/246; 264/247; 264/263; 264/274; 40/27.5

(58) Field of Search ..... 273/148, 148 R; 40/27.5; 264/246, 247; 235/487

(56) References Cited

U.S. PATENT DOCUMENTS 1,935,308 A * 11/1933 Baltzley ..... 40/27.5
3,766,452 A 10/1973 Burpee
3,953,932 A * 5/1976 Graves ..... 40/27.5
3,968,582 A * 7/1976 Jones ..... 40/27.5
4,399,910 A 8/1983 Gutentag
4,435,911 A * 3/1984 Jones ..... 40/27.5
4,703,165 A * 10/1987 Colodner et al. ..... 235/487
4,725,924 A 2/1988 Juan
4,827,640 A * 5/1989 Jones ..... 40/27.5
5,166,502 A * 11/1992 Rendleman et al. ..... 235/492
5,226,665 A * 7/1993 Huang ..... 273/295
5,673,503 A * 10/1997 Rendleman ..... 40/27.5
5,676,376 A * 10/1997 Valley ..... 273/288
5,895,321 A * 4/1999 Gassies et al. ..... 463/29

* cited by examiner

*Primary Examiner*—Benjamin H. Layno
*Assistant Examiner*—Dolores Collins
(74) *Attorney, Agent, or Firm*—Shook, Hardy & Bacon L.L.P.

(57) ABSTRACT

A gaming chip is provided that includes a rigid core element having an outer peripheral edge, and top and bottom surfaces. The core element is formed with at least one ventilating aperture extending from the top surface to the bottom surface. The ventilating aperture relieves any vacuum formed between the chip and an adjacent chip, allowing the chip to be more easily handled. In another embodiment, a method for making a gaming chip is provided. The method includes molding a rigid disk element having an outer peripheral edge, and top and bottom surfaces. At least one ventilating aperture is molded into the disk that extends from the top surface to the bottom surface. The molded ventilating aperture relieves any vacuum formed between the chip and an adjacent chip, allowing the chip to be more easily handled.

17 Claims, 1 Drawing Sheet

Fig. 1.
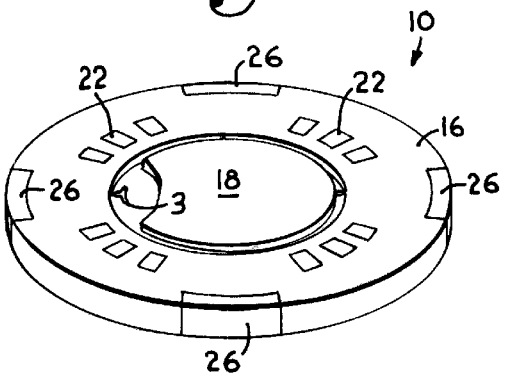
Fig. 2.
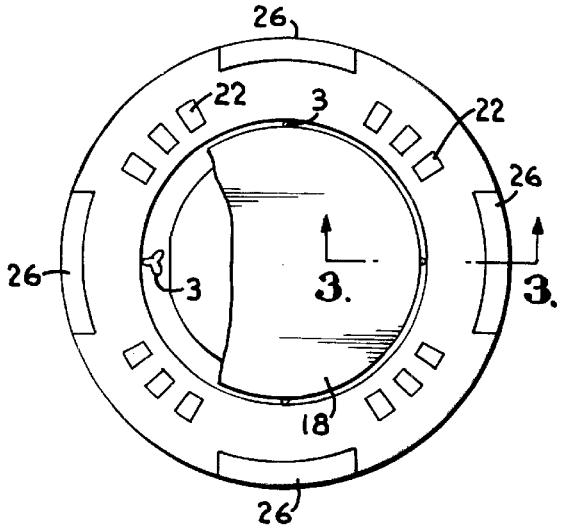
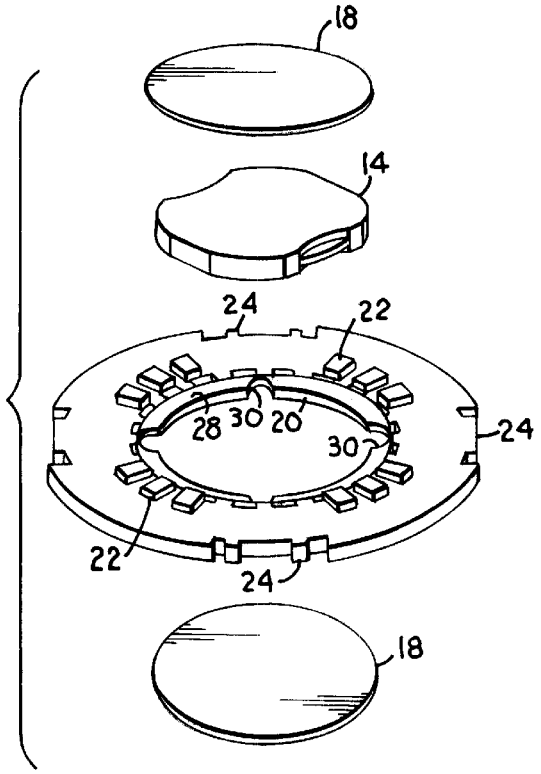
Fig. 4.
Fig. 3.
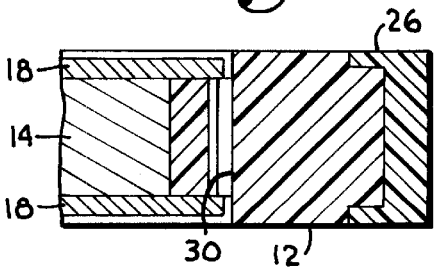

EASY HANDLING GAMING CHIP

BACKGROUND OF THE INVENTION

The present invention relates to gaming chips or tokens and the method for making these chips. More specifically, the invention is directed to a relatively simple and inexpensive gaming chip that can be handled more easily by casino employees and patrons, and a method for making such a chip.

Gaming chips of various denominational values are commonly used in games of chance. These chips are used by patrons to wager a desired amount of money in such a game, and can later be exchanged for currency. In operating these games of chance, casino employees are continuously handling the gaming chips by distributing winnings, making change and accepting wagers. These casino employees, and their employers, desire the ability to handle the gaming chips quickly and easily, so that more time is available to participate in the actual game. For example, the casino employee may form stacks of chips to quickly determine the total value of the chip stack. Casino patrons may also stack chips to place a bet or to determine the value of the chips that the patron may have.

To assist the casino employees and patrons, some chip manufacturers grind the chips flat on both sides, so that a consistent chip height is achieved. This grinding results in chips that are very uniform and easily stacked. However, it has been found that these flat chips have a tendency to "stick" to one another slightly. This tendency can make it difficult to quickly make change, payoff a bet or quickly count chips by stacking and unstacking. At times, when it is desired to remove only a limited number of chips from a stack, the tendency of the chips to slightly stick together can cause the remaining chips in the stack to topple or to become unstacked. The employee or patron must then restack the chips or otherwise place the stack of chips back in order. Therefore, the flat chips have a tendency to undesirably slow the overall operation of the gaming experience.

Another problem in manufacturing prior art chips exists in the manufacturing of single color chips. In the prior art, a first mold or "shot" is made of the particular color. This first mold is merely used to center and hold a weighted disk or plug. The weighted plug is used to give the chip a desired weight and feel. To finish molding the chip, a second mold or shot is molded about the first mold and the weighted plug. The disadvantage of this method is that the resulting one color chip costs the same to make as a two color chip. Therefore, a method of more economically making a one color chip is needed.

Therefore, a chip is needed that overcomes the above drawbacks and disadvantages existing in the prior art. More specifically, a chip is needed that is of a uniform height and that can be easily stacked and unstacked without sticking to adjacent chips. Further, a method is needed for more economically making such a chip.

BRIEF SUMMARY OF THE INVENTION

It is an object of the present invention to provide a gaming chip that can easily be handled by casino employees and patrons without having a tendency to stick to adjacent chips.

It is another object of this invention to provide a gaming chip with a structure that alleviates any tendency to stick to adjacent chips.

It is a further object of the invention to provide a gaming chip that allows air to pass through the chip so that any vacuum formed between two adjacent chips is relieved.

It is yet another oject of the invention to provide a method for making a chip that has a structure that will alleviate any tendency to stick to adjacent chips.

It is still another object of the invention to provide a method of more economically making a one color chip.

According to the present invention, the foregoing and other objects are attained by a gaming chip that includes a rigid core element. The core element has an outer peripheral edge and top and bottom surfaces. At least one ventilating aperture extends from the top surface to the bottom surface. The ventilating aperture substantially eliminates any vacuum effect and allows the gaming chips to be more easily handled by casino employees and patrons. According to another aspect of the present invention, a method for making a gaming chip is also provided. The method includes providing a plurality of spaced core elements. A rigid disk is then molded about the core elements. The core elements operate to form a plurality of ventilating apertures that extend from the top of the disk to the bottom. The ventilating apertures relieve any vacuum formed between the chip and any adjacent chips, which allows the chips to be more easily handled.

Additional objects, advantages, and novel features of the invention will be set forth in part in the description which follows, and in part will be apparent to those skilled in the practice of the invention. The objects and advantages of the invention may be realized and attained by means of the instrumentalities and combinations particularly pointed out in the appended claims.

BRIEF DESCRIPTION OF THE DRAWINGS

In the accompanying drawings which form a part of this specification and which are to be read in conjunction therewith and in which like reference numerals are used to indicate like parts in the various views:

FIG. 1 is a perspective view of the chip of the present invention, with parts being broken away to show particular details of construction;

FIG. 2 is a top plan view of the chip of FIG. 1, with parts being broken away to show particular details of construction;

FIG. 3 is a partial cross-sectional view taken along line 3—3 of FIG. 2; and FIG. 4 is an exploded view of the chip of FIG. 1, absent the molded outer shell.

DETAILED DESCRIPTION OF THE INVENTION

Referring initially to FIG. 1, a gaming chip according to the present invention is broadly designated in the drawings by the reference numeral 10. Chip 10 includes a plastic ring 12, as best seen in FIG. 4, a weighted plug 14 and a molded outer shell 16. Plug 14 can be made from a metal material, such as brass, or can be molded from a heavily filled plastic material which preferably has a specific gravity of about 10. A suitable plastic material for plug 14 is available from LNP Plastics of Exton, Pa., sold under the name THERMOCOMP, model HSG-P-1000A. A label 18 identifying the particular casino is adhesively secured over plug 14 on each side of chip 10.

As best seen in FIG. 4, ring 12 defines an inner open area 20, into which plug 14 is placed, as is more fully described below-Extending from the top and bottom surfaces of ring 12 are raised axial projections 22. As shown, projections 22 are rectangular segments. However, projections 22 can be of any desired shape, and can include numbers and letters. Such a construction is used when a two-color chip is made, with the projections 22 standing out against a different color molded outer shell 16. For example, projections 22 could be used to spell the name of a casino or could be used to signify the denominational value of chip 10. Ring 12 also has spaced radially extending projections 24 around its outer periphery. Projections 24 can define a series of spaced recessed portions, into which a number of inserts 26 can be placed, as best seen in FIG. 1. These inserts are preferably of a different color than ring 12 and outer shell 16. The provision of the inserts enhances the difficulty in counterfeiting chip 10, as is known to those of skill in the art.

Open area 20, as best seen in FIG. 3, has an inner ledge 28 that has a diameter selected to hold plug 14 in place while outer shell 16 is molded about the plug. Ledge 28 is molded with a number of spaced relief areas 30. Preferably, four semi-circular areas 30 are provided and are equidistant from one another. As best seen in FIG. 4, the open end of the semi-circle of each area 30 is oriented to face the center of chip 10. As discussed below, areas 30 provide clearance for an aperture core in the next molding step.

After plug 14 has been placed in ring 12, outer shell 16 is molded around the assembly of the ring and plug. In this step, Y-shaped cores are placed within areas 30 to form Y-shaped apertures 32, as best seen in FIGS. 1 and 2. Apertures 32 are formed with the upper end of the Y facing the center of chip 10. The Y-shaped cores act to create apertures 32 by preventing plastic material from entering the region of the cores. Thus, outer shell 16 is formed to complete the outer portion of chip 10, without filling apertures 32. As best seen in FIG. 2, when label 18 is placed onto chip 10, the label will cover most, but not all of aperture 32. Projections 22 and 24 are sized so that the outermost surfaces thereof are flush with the outer surface of shell 16. Therefore, projections 22 and 24 form a pattern within outer shell 16. This pattern can display, for example, a design, a casino name or a denominational value for the chip.

In an alternative embodiment, apertures 32 are not formed in ring 12, but are formed within outer shell 16 as shell 16 is molded. In this embodiment, a one-color chip can be economically formed. The Y-shaped cores are again placed into the mold to form apertures 32. In this embodiment, however, it is not necessary to first form plastic ring 12 to hold plug 14 in place. Instead, because only one color is needed, the Y-shaped cores are used to hold plug 14 in place. Outer shell 16 is then molded about the Y-shaped cores and plug 14. The resulting chip 10 will appear as shown in FIG. 1, absent projections 22 and inserts 26. A one-color chip can therefore be formed with a weighted plug 14 without the need to first form plastic ring 12, because the Y-shaped cores act to hold plug 14 in place. Apertures 32 again extend through chip 10 to allow a passage for air flow through the chip.

Preferably, plug 14 is positioned relative to shell 16 such that plug 14 is slightly recessed from both the upper and lower surfaces of shell 16. This recessed positioning allows labels 18 to be applied to chip 10 so that they are generally flush with the adjacent surface of shell 16.

While the above-chip has been described as having a plug 14, chip 10 may also bee equipped with a transponder, as is known with the art. A suitable transponder is one manufactured by Philips and sold under the name HITAG, model number HTC MOA2S31, it being understood that other transponders are acceptable so long as they can hold and transmit the desired data of chip 10. If such a transponder is used, plug 14 is formed in a cup-shape to accommodate the transponder and associated antenna.

In the method for making chip 10, plastic ring 12 is first molded into the desired shape described above, including molding areas 30 within ring 12. Plug 14 is then located within open area 20 of ring 12 and is axially centered within ring 12. Thereafter, the ring and plug assembly is placed within a mold where outer shell 16 is formed. Y-shaped cores are placed within areas 30 to form Y-shaped apertures 32. After shell 16 is molded, the assembly has the rough appearance of chip 10. The final step in making chip 10 is to apply labels 18. Preferably, labels 18 are adhesively secured to each side of chip 10. Importantly, labels 18 are shaped and sized so that apertures 32 are not completely covered. As best seen in FIG. 2, a portion of at least one aperture 32 must remain uncovered. Preferably, a small portion of each aperture 32 remains uncovered after labels 18 are attached.

If a one-color chip is desired, it is not necessary to first form plastic ring 12 to hold plug 14 in place. Instead, the Y-shaped cores are used to hold plug 14 in place within the mold. Outer shell 16 is then molded about the cores and plug 14. In this fashion, a one-color chip 10 may be formed having apertures 32 without first forming plastic ring 12.

From the foregoing, it will be seen that this invention is one well adapted to attain all of the ends and objects hereinabove set forth, together with other advantages which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A gaming chip, comprising:

a rigid disk element having an outer peripheral edge, and top and bottom surfaces, said top and bottom surfaces being flat and having a grinded surface finish; and at least one ventilating aperture extending from said top surface to said bottom surface, wherein said at least one ventilating aperture relieves any vacuum formed between the chip and an adjacent chip, allowing the chip to be more easily handled.

2. The gaming chip according to claim 1, including a plurality of ventilating apertures.

3. The gaming chip according to claim 2, wherein said disk element includes a ring having a central open area disposed inwardly of said ventilating apertures towards the center of said disk element and extending from said top surface to said bottom surface, the chip further including a weighted plug disposed in said open area.

4. The gaming chip according to claim 3, wherein said disk element further includes an outer shell molded about said ring.

5. The gaming chip according to claim 4, wherein said ventilating apertures are molded in said outer shell.

6. The gaming chip according to claim 4, wherein said ventilating apertures are disposed in said ring, generally adjacent said open area.

7. The gaming chip according to claim 4, wherein said ventilating apertures have a Y-shaped cross-sectional profile.

8. The gaming chip according to claim 7, wherein said Y-shaped apertures include a primary leg and two secondary legs, wherein said primary leg extends radially outwardly.

9. The gaming chip according to claim 8, further comprising a label affixed to a surface of said disk element, said label being disposed to partially cover said secondary legs of said Y-shaped ventilating apertures.

10. A gaming chip in accordance with claim 9, wherein said disk element is plastic.

11. A method for making a gaming chip, comprising:

providing a plurality of spaced core elements; and molding a rigid disk element, having an outer peripheral edge, and top and bottom surfaces about said core elements, said top and bottom surfaces being flat and having a grinded surface finish, said core elements forming a plurality of ventilating apertures that extend from said top surface to said bottom surface, wherein said ventilating apertures relieve any vacuum formed between the chip and an adjacent chip, allowing the chip to be more easily handled.

12. The method of claim 11, wherein said core elements are Y-shaped.

13. The method according to claim 12, wherein said rigid disk molding step comprises:

molding a ring having a central open area therein;

placing a weighted plug within said central open area; and molding an outer shell around said ring and plug assembly, said outer shell being molded to include said ventilating apertures.

14. The method according to claim 12, wherein said rigid disk molding step comprises:

molding a ring having a central open area therein, said ring also having said ventilating apertures molded therein generally adjacent said open area;

placing a weighted plug within said central open area; and molding an outer shell around said ring and plug assembly, said outer shell being molded so that said ventilating apertures remain open.

15. The method of claim 14, further comprising placing an adhesive label onto each side of the chip and locating said label so that said label at least partially covers said apertures.

16. The method of claim 15, wherein a plurality of said apertures are molded into said ring.

17. The method of claim 13, further comprising placing a weighted plug in a contacting relationship with said core elements, said core elements acting to hold said plug in place, so that a one-color chip can be molded in a one-step molding operation.

* * * * *